US010859975B2

(12) United States Patent
Omura

(10) Patent No.: US 10,859,975 B2
(45) Date of Patent: Dec. 8, 2020

(54) DEVELOPING DEVICE AND IMAGE FORMING APPARATUS INCLUDING THE SAME

(71) Applicant: KYOCERA Document Solutions Inc., Osaka (JP)

(72) Inventor: Hiroyoshi Omura, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/683,716

(22) Filed: Nov. 14, 2019

(65) Prior Publication Data

US 2020/0159142 A1 May 21, 2020

(30) Foreign Application Priority Data

Nov. 16, 2018 (JP) ..... 2018-215727

(51) Int. Cl.
*G03G 21/00* (2006.01)
*G03G 21/20* (2006.01)
*G03G 15/08* (2006.01)

(52) U.S. Cl.
CPC ..... *G03G 21/206* (2013.01); *G03G 15/0896* (2013.01)

(58) Field of Classification Search
CPC ..... G03G 15/0896; G03G 21/20; G03G 21/0052; G03G 21/206; G03G 21/1604; G03G 21/1619; G03G 21/1676; G03G 2215/08; G03G 2221/163; G03G 2221/1645; G03G 2221/1678
See application file for complete search history.

(56) References Cited

FOREIGN PATENT DOCUMENTS

JP 2005-283733 10/2005
JP 2009009074 A * 1/2009

* cited by examiner

*Primary Examiner* — Thomas S Giampaolo, II
(74) *Attorney, Agent, or Firm* — Wenderoth, Lind & Ponack, L.L.P.

(57) ABSTRACT

A developing device includes a bottom cover part that covers a bottom surface of a developing container and forms an air passage extending in a front and rear direction between the bottom surface and the bottom cover part, an air blowing fan that supplies air into the air passage, and an air receiving port that is provided at a front end part of the air passage and receives the air supplied from the outside of the air passage by the air supply unit. Air discharge ports are provided on wall parts on both right and left sides forming the air passage and discharge the air flowing into the air passage to the outside of the air passage.

10 Claims, 11 Drawing Sheets

1
2
3
4
5
6
7
8
9
10
11
12
14
15
16
17
18
19
20
P
Right side
Left side

DEVELOPING DEVICE AND IMAGE FORMING APPARATUS INCLUDING THE SAME

CROSS-REFERENCE TO RELATED APPLICATION

This application is based upon and claims the benefit of priority from Japanese Patent Application No. 2018-215727 filed on Nov. 16, 2018, the entire contents of which are incorporated herein by reference.

BACKGROUND

The technology of the present disclosure relates to a developing device and an image forming apparatus including the same.

In general, an electrophotographic image forming apparatus includes a developing device that develops an electrostatic latent image formed on the surface of a photosensitive drum by using toner, a transfer device that transfers a toner image developed by the developing device onto a recording sheet, and a fixing device that fixes the toner image, which has been transferred onto the recording sheet by the transfer device, to the recording sheet.

The developing device is composed of a developing container that accommodates toner, and a developing roller that rotates with a developer carried on the surface thereof.

In the developing device, when the temperature of the toner in the device rises above a melting point, since the toner is molten and fused to the developing roller and the like, thereby causing image failure.

In order to solve such a problem, it is proposed a cooling technology of suppressing temperature rise of the entire developing device by applying cooling air to the developing device. In such a cooling technology, air flow taken into the image forming apparatus by an air blowing fan is blown to the entire image forming part including the developing device from an axial direction. The image forming part includes the photosensitive drum, a charging device, and a cleaning device, in addition to the developing device.

SUMMARY

A developing device according to one aspect of the present disclosure includes a developing roller and a developing container. The developing roller supplies toner toward an image carrying member. The developing container accommodates the developing roller therein.

Furthermore, the developing device includes a bottom cover part, an air supply unit, an air receiving port, and air discharge ports. The bottom cover part covers a bottom surface of the developing container and forms an air passage between the bottom surface and the bottom cover part. The air passage extends in an axal direction of the developing roller. The air supply unit supplies air into the air passage. The air receiving port is provided at one side end part of the air passage in the axial direction of the developing roller. The air receiving port receives the air supplied from the outside of the air passage by the air supply unit. The air discharge ports are provided on wall parts on both sides in an air passage width direction (direction orthogonal to the axial direction of the developing roller) of wall parts forming the air passage. The air discharge ports discharge the air flowing into the air passage to the outside of the air passage.

DETAILED DESCRIPTION

Hereinafter, an embodiment of the technology of the present disclosure will be described in detail on the basis of the drawings. It is noted that the technology of the present disclosure is not limited to the following embodiment.

[Overall Configuration]

Figure 1:
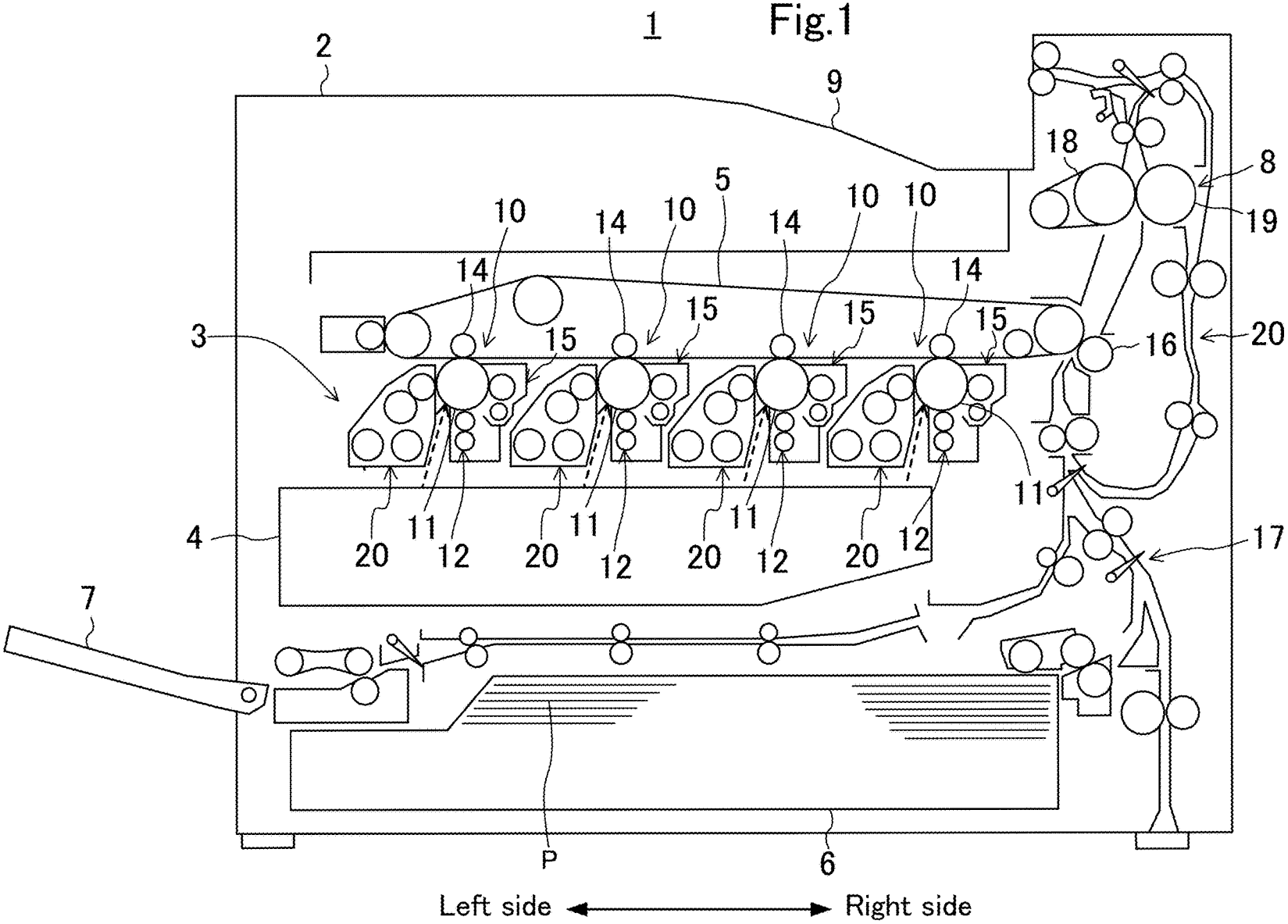
FIG. 1 is an overall schematic diagram illustrating an image forming apparatus in an embodiment.

FIG. 1 illustrates a schematic configuration diagram of an image forming apparatus 1 according to an embodiment. The image forming apparatus 1 is a tandem type color printer and includes an image forming unit 3 in a box-shaped casing 2. The image forming unit 3 is a part that transfers an image to a recording sheet P and forms the image on the recording sheet P on the basis of image data transmitted from an external device such as a computer subjected to network connection and the like. Below the image forming unit 3, an exposure device 4 is disposed to emit laser light, and above the image forming unit 3, a transfer belt 5 is disposed. Below the exposure device 4, a sheet storage unit 6 is disposed to store the recording sheet P, and on the lateral side of the sheet storage unit 6, a manual sheet feeding unit 7 is disposed. On a lateral upper side of the transfer belt 5, a fixing unit 8 is disposed to perform a fixing process on the image transferred to and formed on the recording sheet P. A reference numeral 9 indicates a sheet discharge unit disposed at an upper part of the casing 2 to discharge the recording sheet P subjected to the fixing process in the fixing unit 8.

The image forming unit 3 includes four image forming units 10 disposed in a row along the transfer belt 5. Each of the image forming units 10 has a photosensitive drum 11 as an image carrying member. Directly under each photosensitive drum 11, a charging device 12 is disposed, and on one side of each photosensitive drum 11, a developing unit 20 (an example of a developing device) is disposed. Directly above each photosensitive drum 11, a primary transfer roller 14 is disposed, and on the other side of each photosensitive drum 11, a cleaning unit 15 is disposed to clean the peripheral surface of the photosensitive drum 11.

The peripheral surface of each photosensitive drum 11 is uniformly charged by the charging device 12, and laser light corresponding to each color based on the image data inputted from the aforementioned computer and the like are emitted to the charged peripheral surface of the photosensitive drum 11 from the exposure device 4, so that an electrostatic latent image is formed on the peripheral surface of each photosensitive drum 11. A developer is supplied to the electrostatic latent image from the developing unit 20, so that a toner image of yellow, magenta, cyan, or black is formed on the peripheral surface of each photosensitive drum 11. These toner images are respectively superposed on and transferred to the transfer belt 5 by a transfer bias applied to the primary transfer roller 14.

A reference numeral 16 indicates a secondary transfer roller disposed below the fixing unit 8 in the state of abutting the transfer belt 5, wherein the recording sheet P conveyed along a sheet conveyance path 17 from the sheet storage unit 6 or the manual sheet feeding unit 7 is interposed between the secondary transfer roller 16 and the transfer belt 5 and the toner images on the transfer belt 5 are transferred to the recording sheet P by a transfer bias applied to the secondary transfer roller 16.

The fixing unit 8 includes a heating roller 18 and a pressure roller 19, wherein the recording sheet P is interposed by the heating roller 18 and the pressure roller 19 so as to be heated and pressed, so that the toner images, which have been transferred to the recording sheet P, are fixed to the recording sheet P. The recording sheet P subjected to the fixing process is discharged to the sheet discharge unit 9. A reference numeral 20 indicates a reversing conveyance path for reversing the recording sheet P discharged from the fixing unit 8, at the time of duplex printing.

Figure 2:
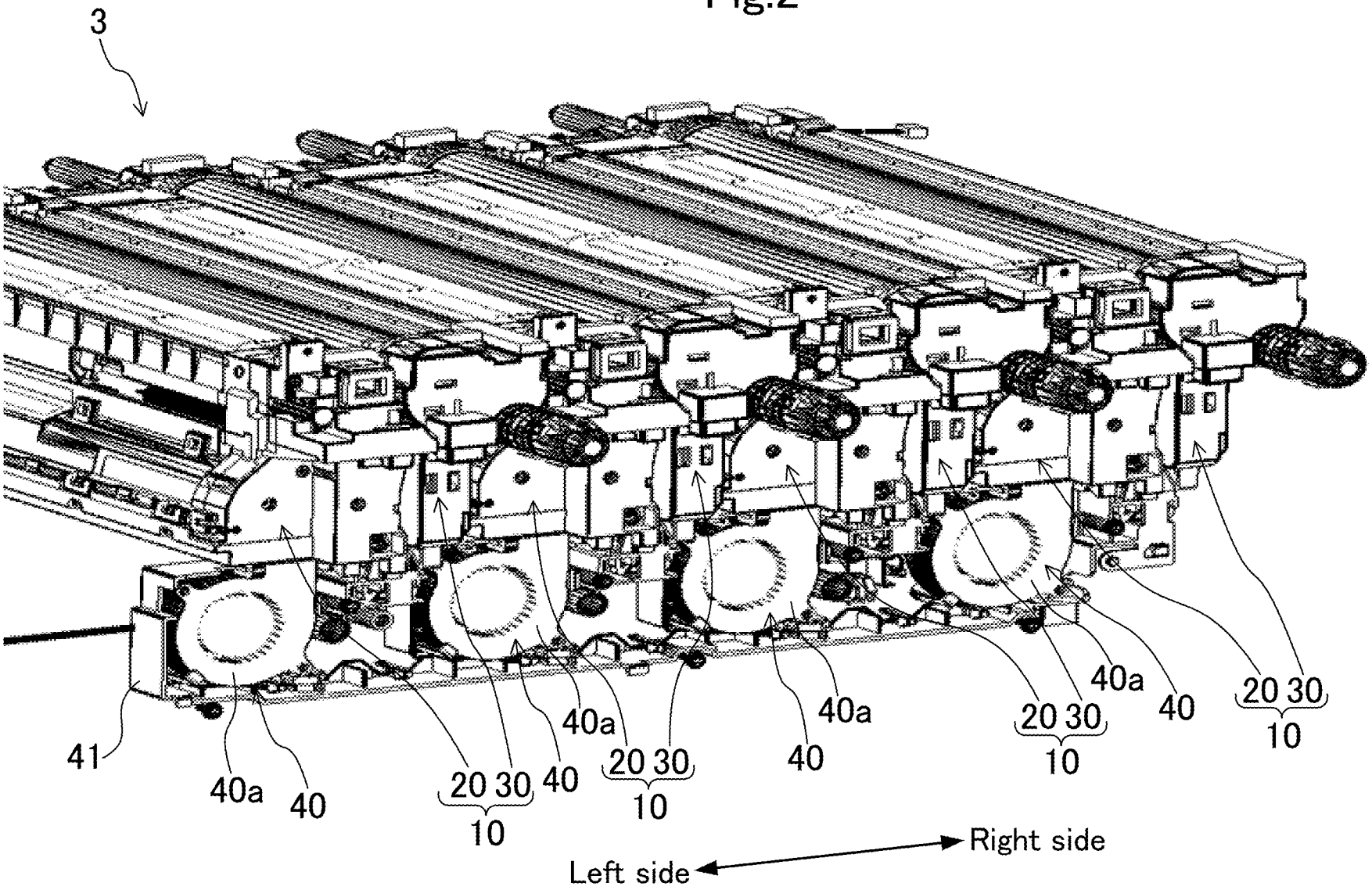
FIG. 2 is a perspective view illustrating an image forming unit and four air blowing fans as air supply units.

FIG. 2 is a perspective view illustrating the four image forming units 10 constituting the image forming unit 3, and four air blowing fans 40 as air supply units.

Each of the image forming units 10 includes a developing unit 20 and a photosensitive drum unit 30. The photosensitive drum unit 30 is configured by unitizing the photosensitive drum 11, the charging device 12, and the cleaning device 15. The developing unit 20 and the photosensitive drum unit 30 are disposed in a pair in order from the left side for each color of black, cyan, magenta, and yellow.

Each of the four air blowing fans 40 is connected to a front end part of each developing unit 20 from below. Although not illustrated in FIG. 2, a foreign matter collecting device 50 (see FIG. 10) to be described below is connected to upper end pars of the four developing unit 20.

Figure 3:
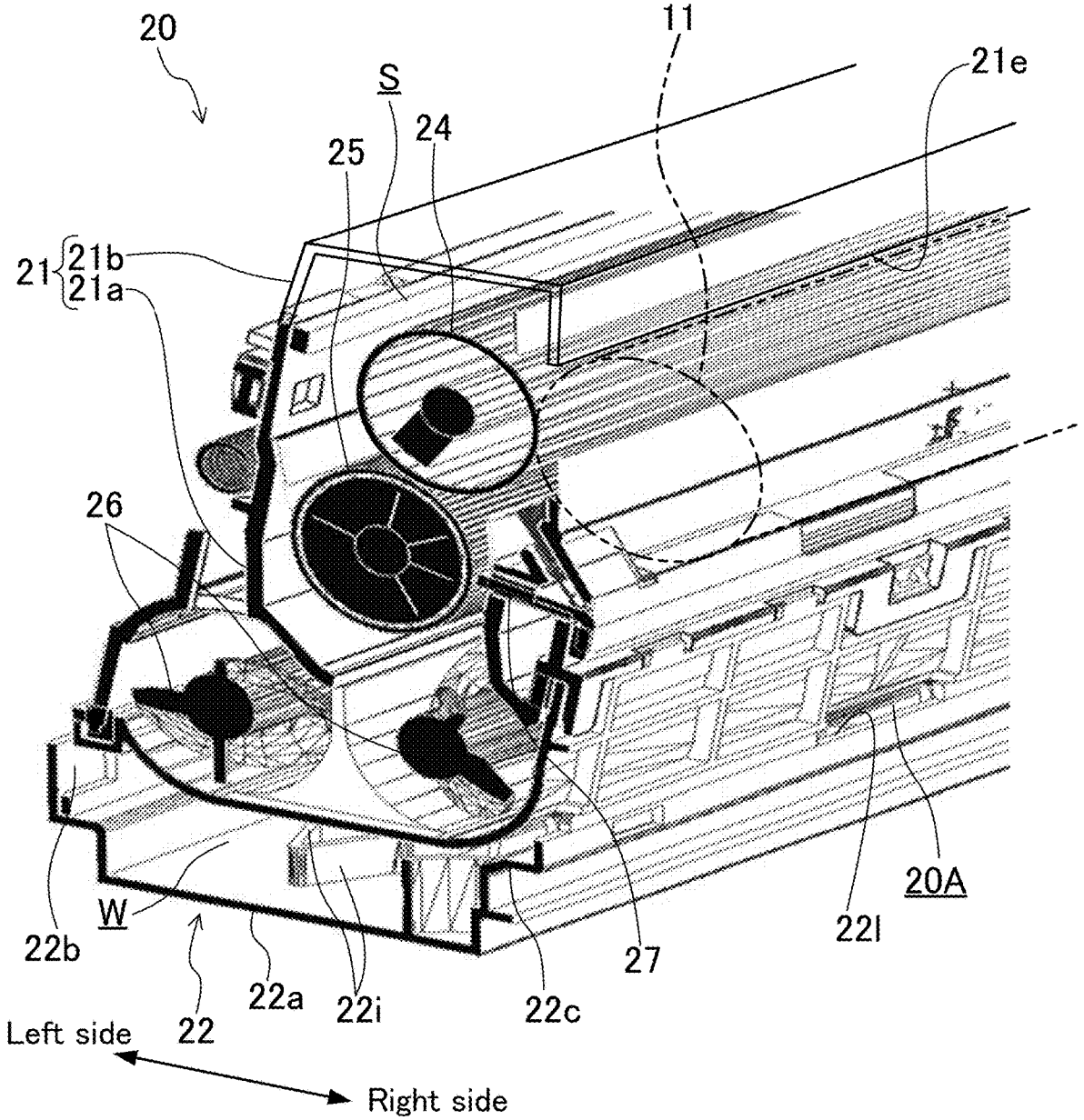
FIG. 3 is a cut model in which a developing unit is cut along a vertical plane along a right and left direction.

[Configuration of developing unit 20] As described in FIG. 3, the developing unit 20 has a developing container 21 and a bottom cover part 22 disposed to cover the bottom surface of the developing container 21. The developing container 21 has a bottomed case body 21*a* opened upward and an upper cover 21*b* that detachably closes an upper side of the case body 21*a*.

Furthermore, a developing roller 24, a magnetic roller 25, two toner conveying screws 26, and a regulating blade 27 are accommodated in the developing container 21 (case body 21*a*).

The developing roller 24 is disposed at an upper end part in the developing container 21, is exposed from an opening 21*e* formed on a right side surface of the developing container 21, and faces the photosensitive drum 11. The magnetic roller 25 is disposed at the obliquely lower left of the developing roller 24. The two toner conveying screws 26 are disposed side by side in a space below the magnetic roller 25. The regulating blade 27 is disposed on a right side of the magnetic roller.

Furthermore, the two toner conveying screws 26 conveys and stirs a two-component developer including toner and carrier, thereby charging the toner. The charged toner is supplied to a surface of the magnetic roller 25 by the toner conveying screws 26, so that a magnetic brush is formed on the surface of the magnetic roller 25. The thickness of the magnetic brush on the magnetic roller 25 is regulated by the regulating blade 27. Between the magnetic roller 25 and the developing roller 24, a potential difference is generated by a developing voltage power source (not illustrated), and when the magnetic brush is moved in the vicinity of the developing roller 24, only the charged toner is moved to the developing roller 24 due to the potential difference. The toner moved to the developing roller 24 becomes a uniform layer. Furthermore, also between the photosensitive drum 11 and the developing roller 24, a potential difference is generated by the developing voltage power source. Thus, by the potential difference, the toner on the surface of the developing roller 24 is moved (flown) to the surface of the photosensitive drum 11 and the moved toner is attached to the electrostatic latent image formed on the surface of the photosensitive drum 11, so that the electrostatic latent image on the drum surface is developed.

[Configuration of Bottom Cover Part 22]

The bottom cover part 22 extends in a front and rear direction so as to cover the entire bottom surface of the developing container 21. Between the bottom cover part 22 and the bottom surface of the developing container 21, an air passage W is ensured to extend across the entire front and rear direction of the bottom surface. As will be described below, air is taken into the air passage W from a front end part of the air passage W by the air blowing fans 40.

Figure 4:
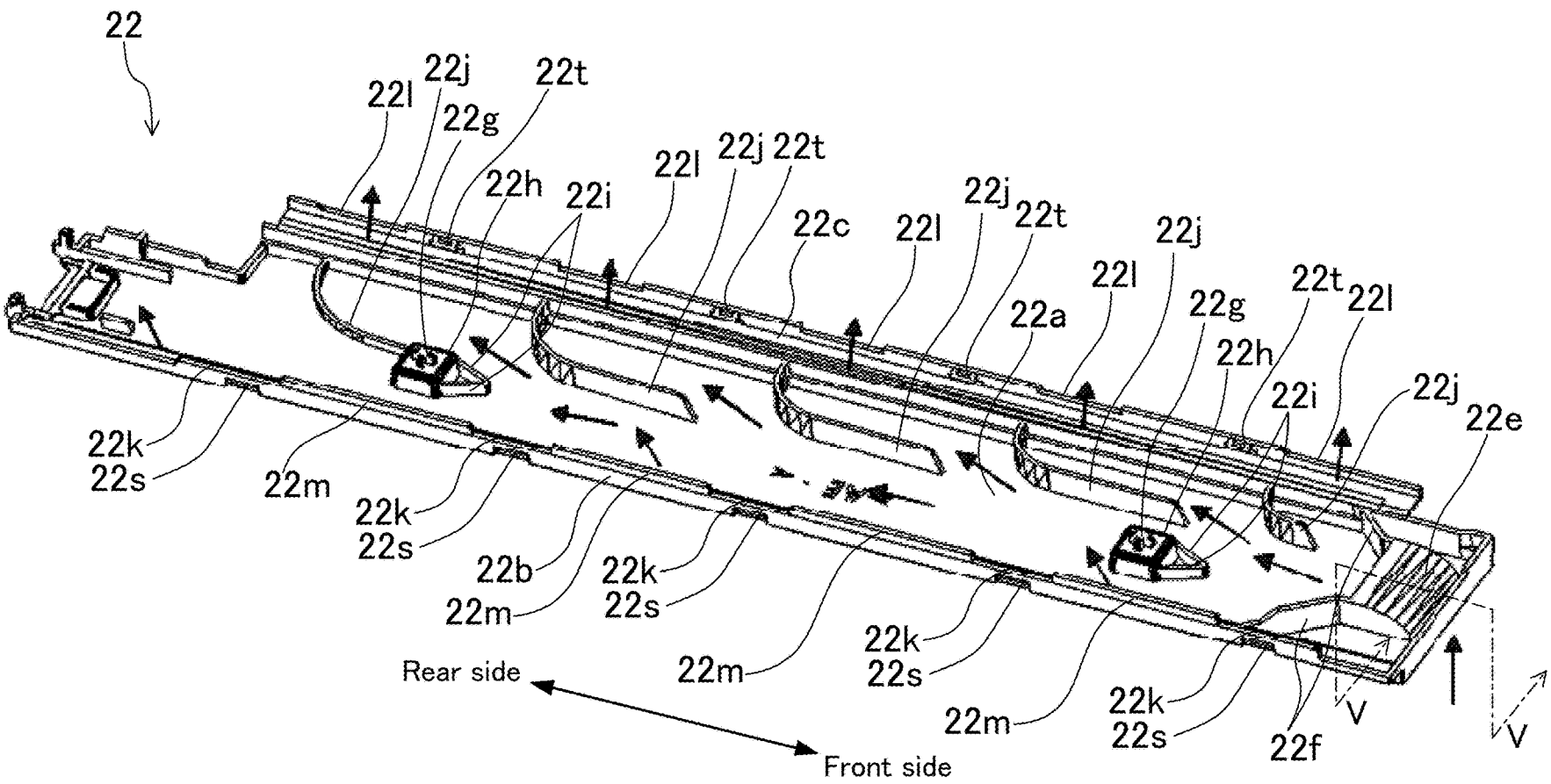
FIG. 4 is a perspective view illustrating a bottom cover of the developing unit.
Figure 5:
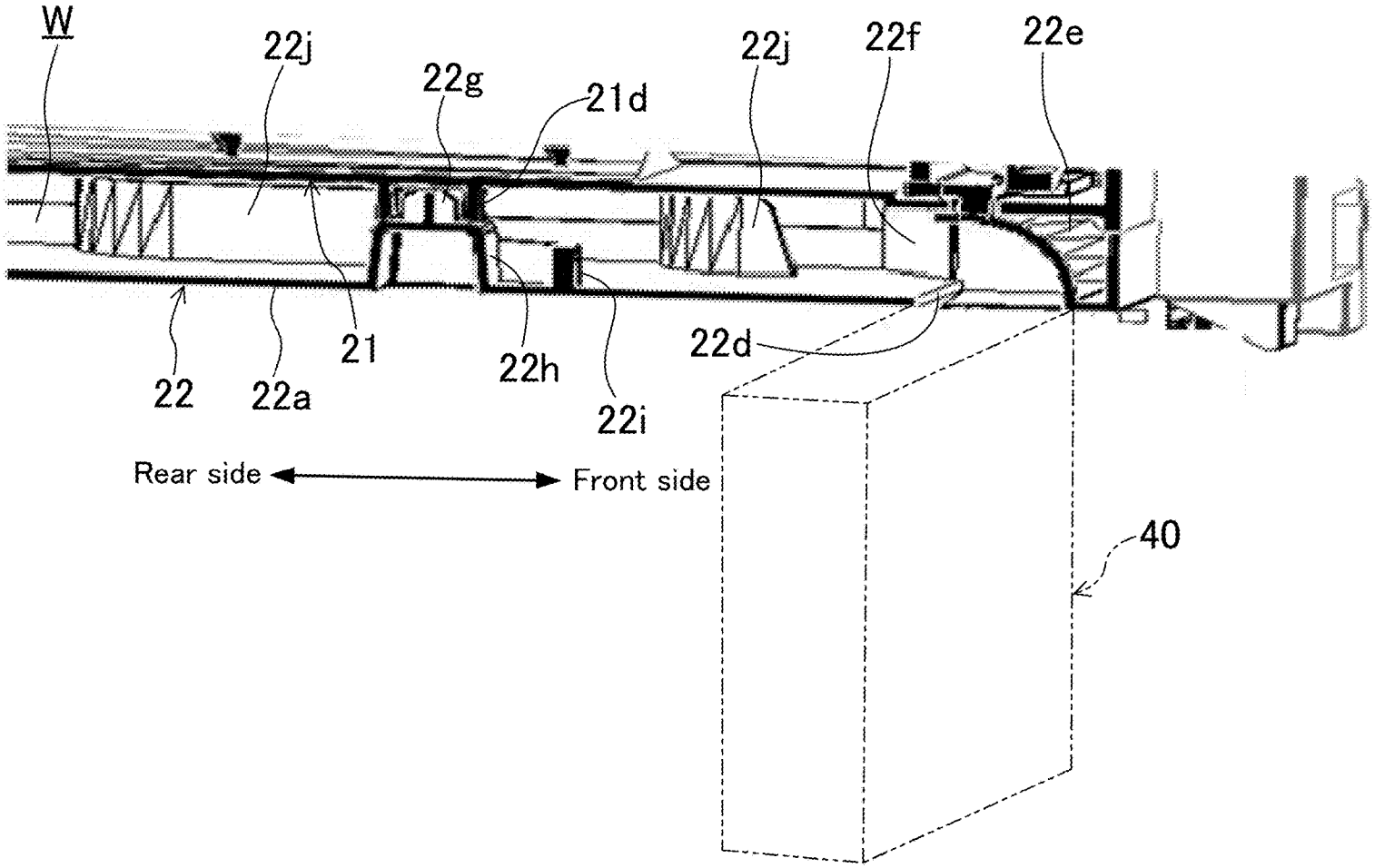
FIG. 5 is a sectional view taken along line V-V of FIG. 4.

With reference to FIG. 4 and FIG. 5, a detailed shape of the bottom cover part 22 will be described. FIG. 4 is a perspective view illustrating a state in which the bottom cover part 22 has been removed from the bottom surface of the developing container 21, and FIG. 5 is a sectional view taken along line V-V of FIG. 4.

The bottom cover part 22 is formed in a flat rectangular tray shape opened upward in an overall view. The bottom cover part 22 has an approximately rectangular bottom wall 22*a* extending in the front and rear direction, a left wall 22*b* protruding in a bent plate shape upward from a left end edge of the bottom wall 22*a*, and a right wall 22*c* protruding in a bent plate shape upward from a right end edge of the bottom wall 22*a*.

The bottom wall 22*a* is formed at the front end part thereof with a rectangular air receiving port 22*d* (see FIG. 5 and FIG. 8) by passing through the bottom wall 22*a* in a thickness direction.

A guide duct part 22*e* is formed at the front end part of the upper surface of the bottom wall 22*a* to guide air flow flowing from the air receiving port 22*d* toward the rear side from the front side. As illustrated in FIG. 5, an inner surface of the guide duct part 22*e* is curved in an arch shape on the front side toward the upper side. An air outlet of the guide duct part 22*e* is connected to a pair of diffuser plates 22*f*. The pair of diffuser plates 22*f* are disposed to spread in a V shape on both sides in a width direction toward the rear side.

At the center part in the width direction on the upper surface of the bottom wall 22*a*, a pair of positioning seat parts 22*h* are formed to be arranged at an interval in the front and rear direction. Each of the positioning seat parts 22*h* has a rectangular pillar protruding from the upper surface of the bottom wall 22*a*. A cross-shaped positioning protrusion 22*g* protrudes from the upper surface of each of the positioning seat parts 22*h*. The positioning protrusion 22*g* engages with a positioning hole 21*d* (see FIG. 5) as an engaged part engaged with the bottom surface of the developing container 21, so that the bottom cover part 22 is positioned with respect to the developing container 21. A pair of rectifying plates 22*i* are connected to front end surfaces of the positioning seat parts 22*h*. The pair of rectifying plates 22*i* are disposed to spread in a V shape toward the rear side from the front side. The rectifying plate 22*i* has a function of rectifying air flow toward the positioning seat parts 22*h* by dividing the air flow into both right and left sides.

Five guide plates 22*j* arranged at intervals in the front and rear direction protrude from the right end part of the upper surface of the bottom wall 22*a*. Each of the guide plates 22*j* linearly extends toward the rear side from the front side, is curved in an arc shape toward the right side (outside in the width direction), and then is connected to the right wall 22*c*.

Figure 6:
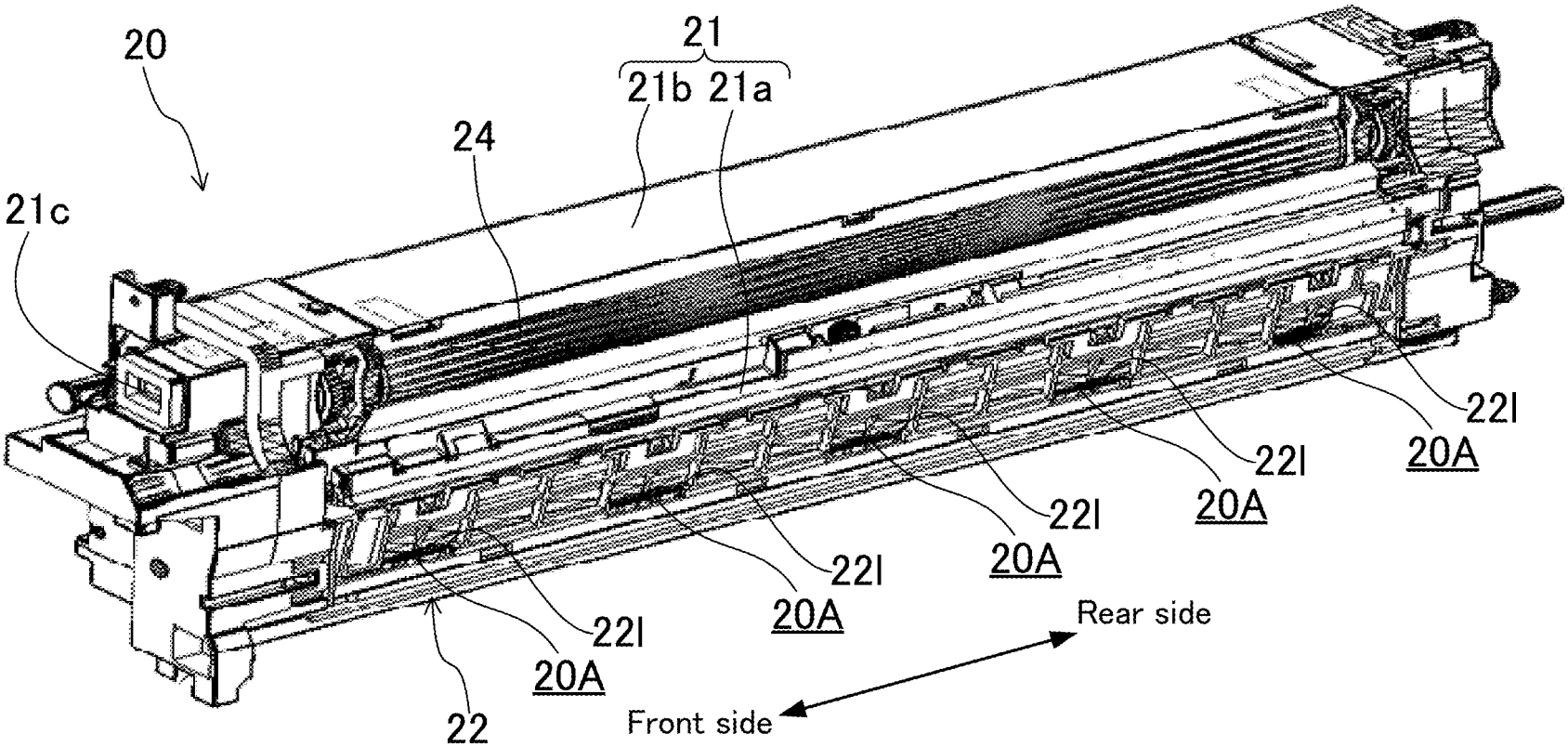
FIG. 6 is a perspective view when the developing unit is viewed from a front oblique right side.

The right wall 22*c* of the bottom cover part 22 is formed with five notches 22*l* through which air flow guided by each of the guide plates 22*j* passes. The notch 22*l* is formed to be long in the front and rear direction and is opened upward. Parts located among the five notches 22*l* in the right wall 22*c* are respectively provided with engagement holes 22*t* that engage with claw parts provided at the bottom part of the developing container 21. As illustrated in FIG. 6, in a state in which the bottom cover part 22 is attached to the bottom part of the developing container 21, air discharge ports 20A are formed among the five notches 22*l* and the developing container 21, respectively. In the present embodiment, the number of air discharge ports 20A is five; however, the number of air discharge ports 20A may be four or less or six or more.

Figure 7:
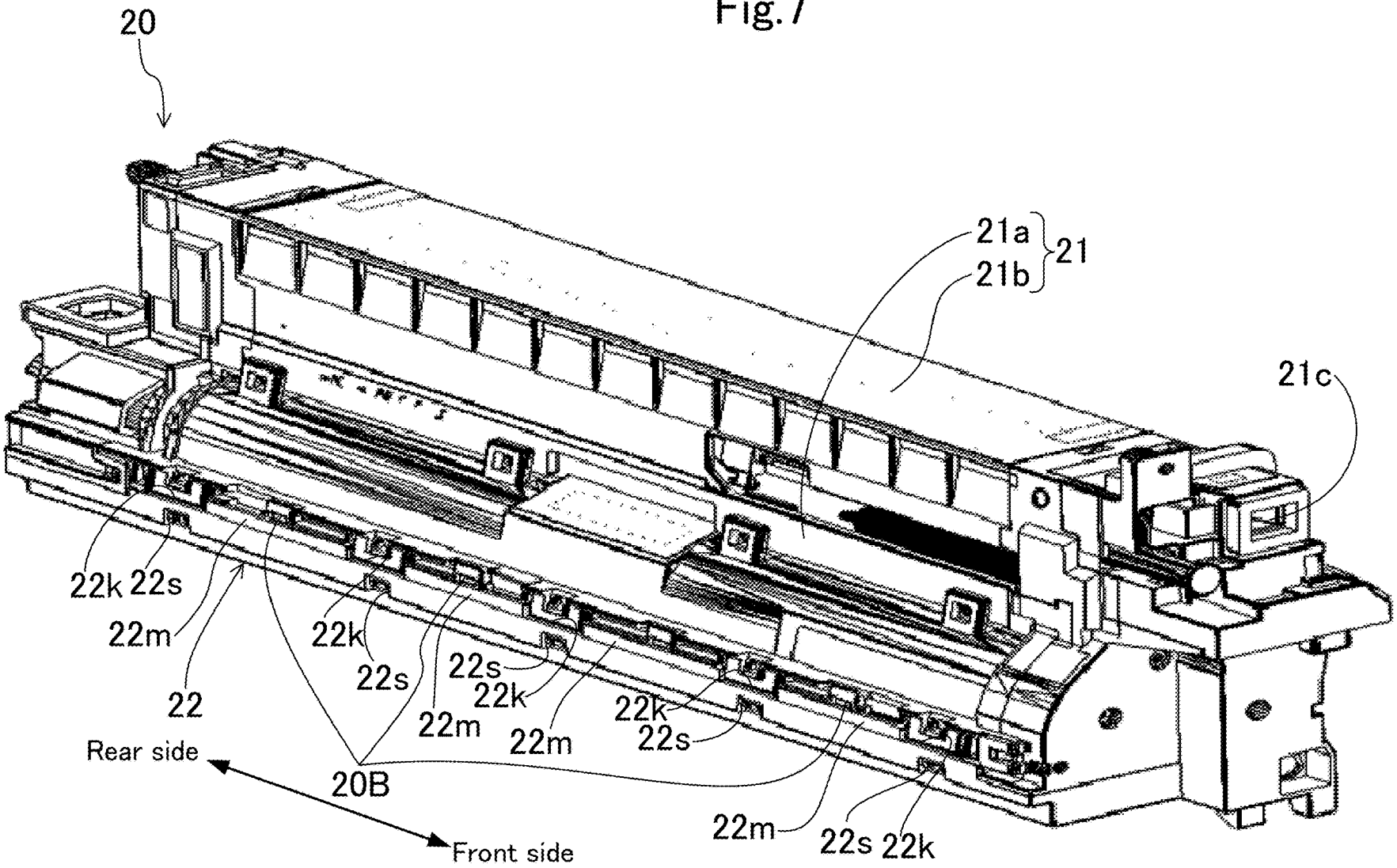
FIG. 7 is a perspective view when the developing unit is viewed from a front oblique left side.
Figure 8:
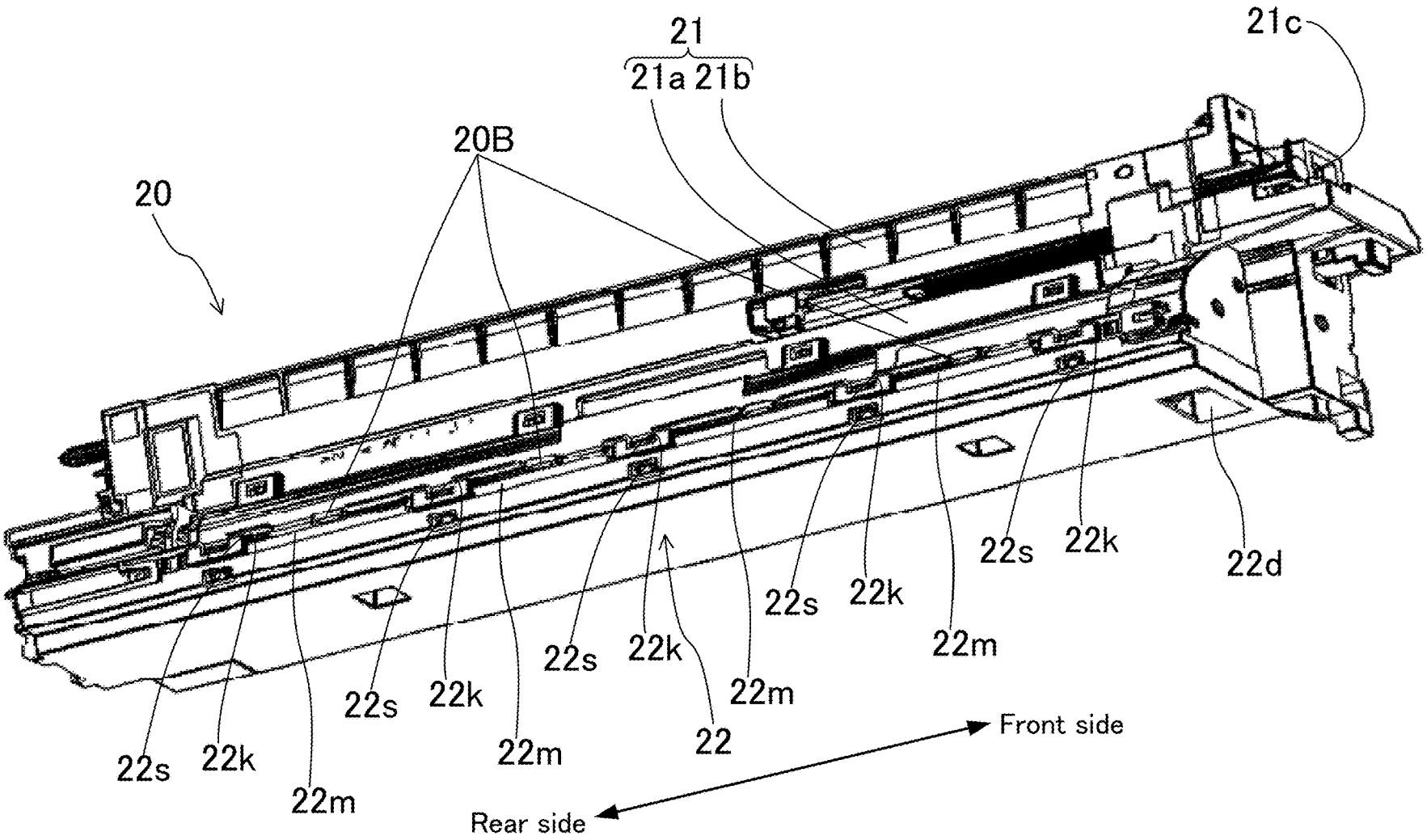
FIG. 8 is a perspective view when the developing unit is viewed from a left oblique lower side.

On the other hand, on the left wall 22*b* of the bottom cover part 22, five notches 22*k* for avoiding interference are formed side by side in the front and rear direction, and an engagement hole 22*s* is formed below each of the notches 22*k*. As illustrated in FIG. 7 and FIG. 8, in the state in which the bottom cover part 22 is attached to the bottom part of the developing container 21, the engagement holes 22*s* engage with the claw parts formed in the developing container 21. Furthermore, air discharge ports 20B are formed between three of four straight parts 22*m* located among the notches 22*k* in the left wall 22*b* and the developing container 21, respectively. Each of the air discharge ports 20B is formed by a U-shaped groove formed in the developing container 21 and opened downward and the straight part 22*m*. In the present embodiment, the number of air discharge ports 20B is three; however, the technology of the present disclosure is not limited thereto and the number of air discharge ports 20B may be four or more or two or less.

A peripheral end edge of the bottom cover part 22 abuts (closely adheres to) the developing container 21 at the entire peripheral edge except for the parts where the air discharge ports 20A and 20B are formed. Consequently, the air flow flowing into the air passage W from the air receiving port 22*d* is discharged to the outside from only the air discharge ports 20A and 20B.

As illustrated in FIG. 8, the air receiving port 22*d* of the bottom cover part 22 has a rectangular shape that is long in the right and left direction when viewed from the lower surface side. The air blowing fans 40 (see FIG. 2) are connected to the air receiving port 22*d*.

The air blowing fan 40 has a spiral casing 40*a* that accommodates a fan body, and an outlet of the casing 40*a* is connected to the air receiving port 22*d*. Each of the air blowing fans 40 is held to a fan holder 41 that is provided below the four image forming units 10 and is long in the right and left direction. The fan holder 41 is attached and fixed to a front sheet metal (not illustrated) of the image forming apparatus 1.

[Air Circulation Path]

Figure 9:
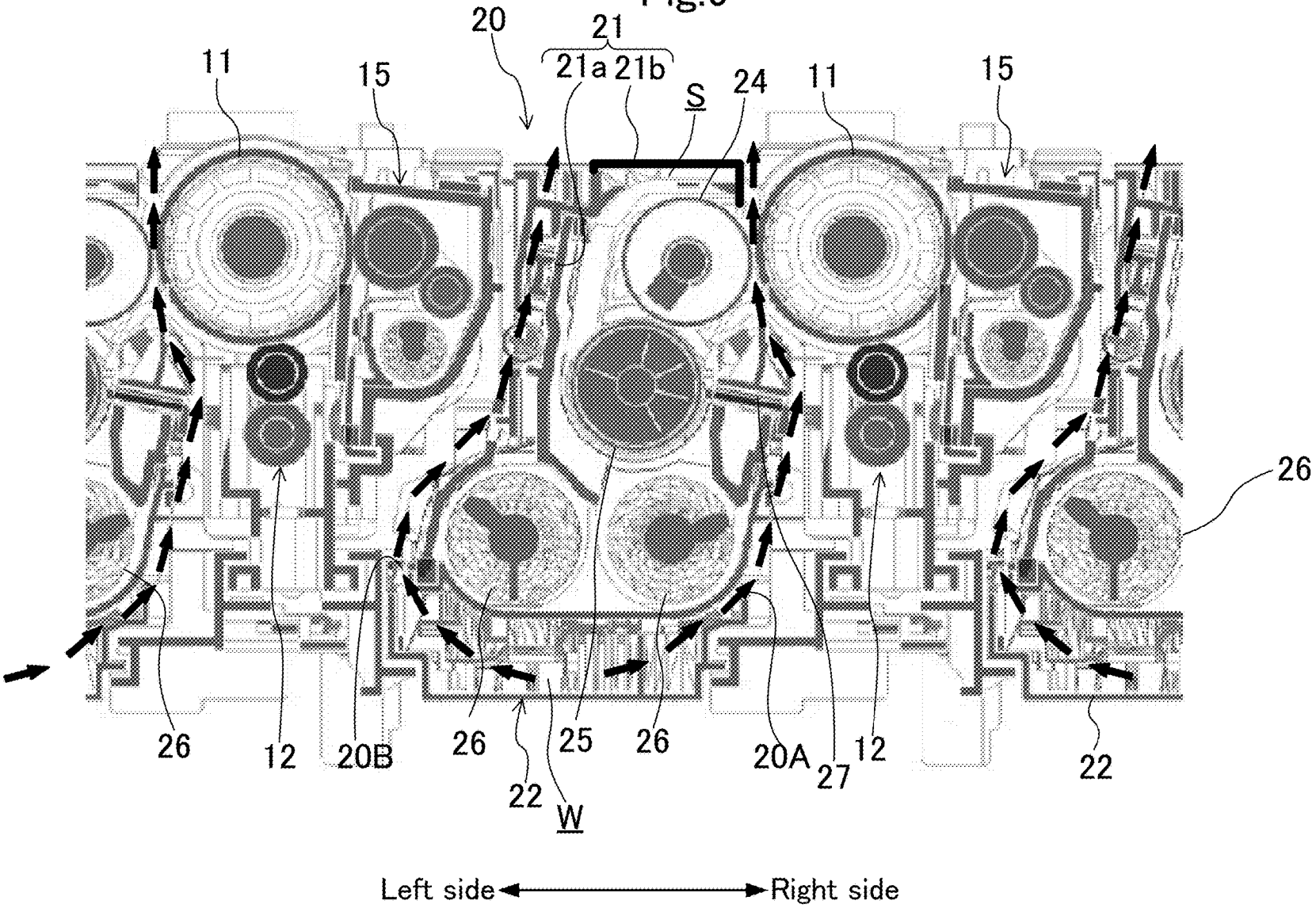
FIG. 9 is an explanation diagram for explaining the flow of air flow when the developing unit is viewed from a front side.

Next, with reference to FIG. 4, FIG. 5, and FIG. 9, an air circulation path during the operation of the air blowing fan 40 will be described. Arrows in FIG. 4 and FIG. 9 schematically indicate the flow of air.

When the air blowing fan 40 is operated, air flows into the guide duct part 22*e* from the air receiving port 22*d* of the bottom cover part 22. The inflowing air flow is guided into the air passage W by the guide duct part 22*e* and flows toward the rear side from the front side (see FIG. 4 and FIG. 5). Since the air passage W communicates with the outside only at the three air discharge ports 20B on the left side and the five air discharge ports 20A on the right side, the air is discharged to the outside of the air passage from each of the air discharge ports 20A and 20B. The discharged air flows upward along both right and left side surfaces of the developing container 21 and escapes to the transfer belt 5 side (see FIG. 9).

The air discharged from the air discharge ports 20A on the right side passes between the developing roller 24 and the photosensitive drum 11 and escapes to the transfer belt 5 side. In such a case, the toner may be scattered from the surface of the developing roller 24 due to air inertia force and attached to the transfer belt 5. In order to solve such a problem, in the present embodiment, the foreign matter collecting device (see FIG. 10) is connected to the front end part of the upper end part of the developing container 21.

[Configuration of Foreign Matter Collecting Device 50]

Figure 10:
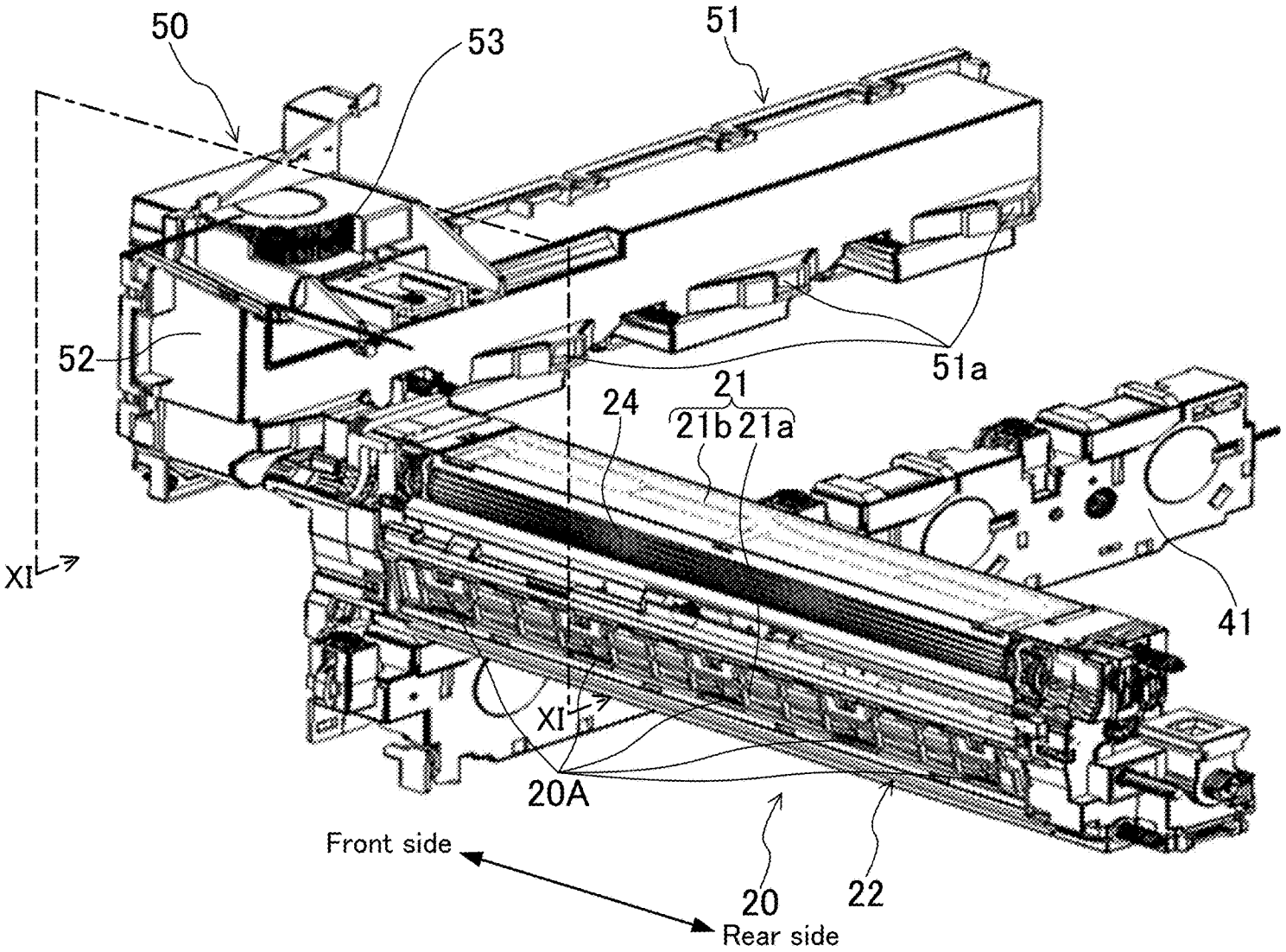
FIG. 10 is a perspective view when a foreign matter collecting device, the developing unit, and a fan holder holding fans are viewed from a rear oblique right side.

As illustrated in FIG. 10, the foreign matter collecting device 50 has a horizontal duct part 51 extending horizontally in the right and left direction and a vertical duct part 52 vertically connected to a right end part of the horizontal duct part 51.

At the lower end part of a rear side surface of the horizontal duct part 51, four air introduction ports 51*a* are formed to be arranged at intervals in the right and left direction. Each of the air introduction ports 51*a* is connected to an opening 21*c* formed at the upper end part of the front side surface of each developing container 21 (FIG. 10 illustrates only the developing container 21 at the right end). The opening 21*c* communicates with a space S (see FIG. 9) extending in the front and rear direction adjacent to the upper cover 21*b* of the developing container 21.

Figure 11:
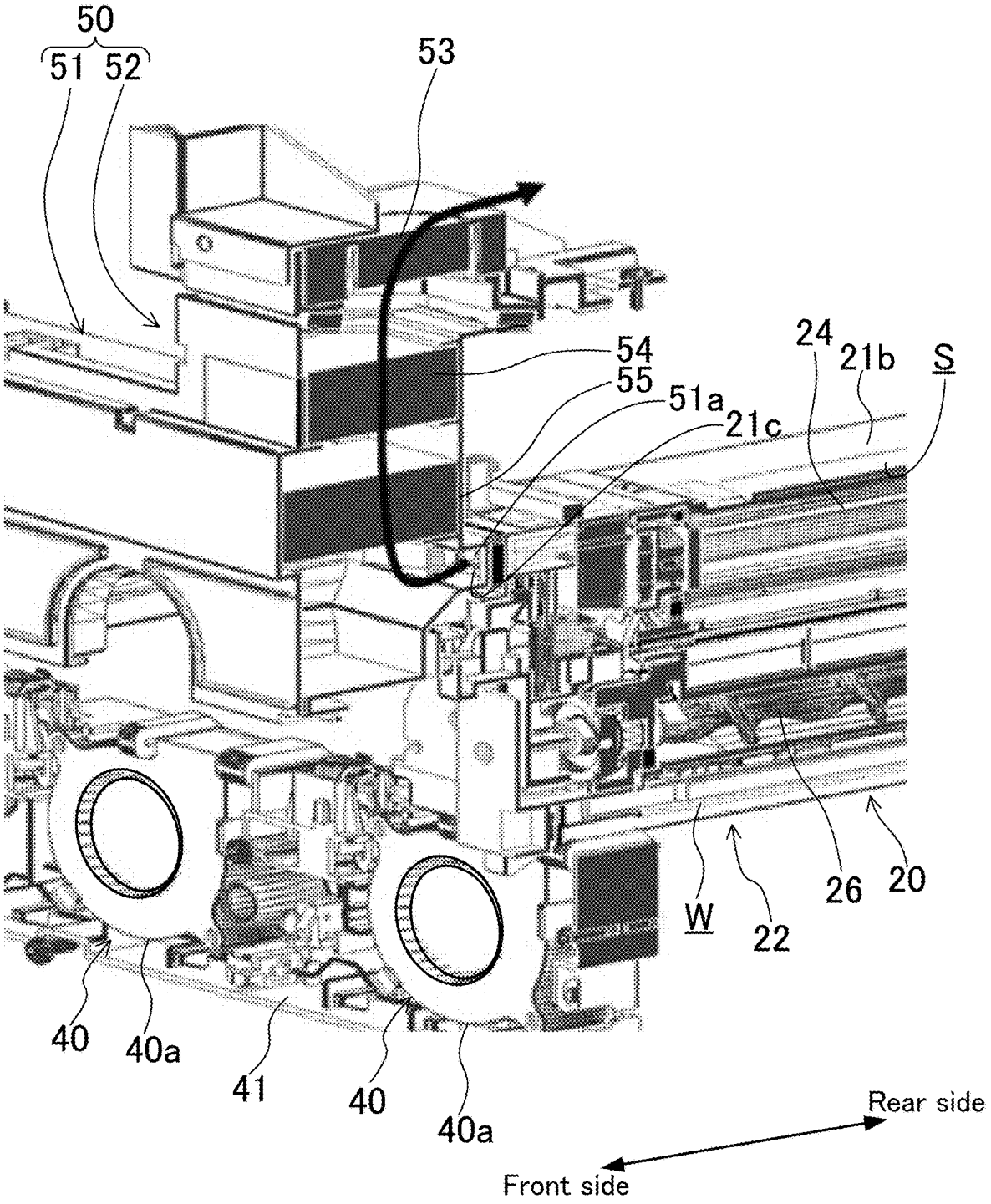
FIG. 11 is a sectional view taken along line XI-XI of FIG. 10.

As illustrated in FIG. 11, the vertical duct part 52 is provided at the upper end part thereof with a suction fan 53. On a lower side of the suction fan 53 in the vertical duct part 52, two foreign matter collecting filters 54 and 55 are arranged vertically.

When the suction fan 53 is operated, the vertical duct part 52 and the horizontal duct part 51 enter a negative pressure state. As a consequence, the air in the space S at the upper end part of the developing container 21 flows into the horizontal duct part 51 through the opening 21*c* and the air introduction port 51*a*. The inflowing air passes through the two foreign matter collecting filters 54 and 55 and is discharged from an upper end opening of the vertical duct part 52.

As described above, in the present embodiment, the developing unit 20 includes the bottom cover part 22 that covers the bottom surface of the developing container 21 and forms the air passage W extending in the front and rear direction (the axial direction of the developing roller 24) between the bottom surface and the bottom cover part 22, the air blowing fans 40 that supply air into the air passage W, and the air receiving port 22*d* provided at the front end part (an example of one side end part) of the air passage W to receive the air supplied from the outside of the air passage W by the air blowing fans 40. Furthermore, the air discharge ports 20A and 20B are provided in the wall part on both right and left sides forming the air passage W to discharge the air flowing into the air passage W to the outside of the air passage W.

According to this, as described above, the air flow discharged from each of the air discharge ports 20A and 20B flows upward along both right and left side surfaces of the developing container 21. Consequently, it is possible to efficiently cool the entire developing unit 20 with a small air flow rate. Thus, for example, as compared with a case where the developing unit 20 is cooled by blowing a large amount of air across the entire image forming unit 3, it is possible to efficiently cool the developing unit 20 while preventing scattering of toner from the developing unit 20. Furthermore, since the air flow rising along both right and left side surfaces of the developing container 21 finally comes in contact with the transfer belt 5, the air flow can also be used for cooling the transfer belt 5.

Furthermore, the guide plates 22*j* protrude from the upper surface of the bottom cover part 22 so as to guide the air flow, which flows into the air passage W from the air receiving port 22*d*, toward the air discharge ports 20A on the right side.

According to this, it is possible to smoothly guide the air flow toward each of the air discharge ports 20A. Thus, the discharge performance of the air flow from each of the air discharge ports 20A is improved. Accordingly, power required for the air blowing fan 40 is reduced, so that it is possible to miniaturize the air blowing fan 40.

Furthermore, the guide plates 22*j* are formed only at the right end part of the bottom wall 22*a* of the bottom cover part 22. According to this, the air flow rate discharged from the air discharge ports 20A on the right side is larger than that discharged from the air discharge ports 20B on the left side. Consequently, it is possible to increase the cooling capacity of the photosensitive drum 11 side where temperature becomes relatively high between the right and left side surfaces of the developing unit 20. Thus, it is possible to efficiently cool the developing unit 20 with a small air flow rate.

Furthermore, the bottom cover part 22 is composed of a member different from that of the developing container 21, and on the front side (that is, an upstream side in the air circulation direction) of the positioning seat part 22*h* formed on the upper surface of the bottom wall 22*a*, the rectifying plate 22*i* is provided to rectify the air flow by branching the air flow to both sides in the air passage width direction (direction orthogonal to the axial direction of the developing roller 24).

According to this, it is possible to prevent an increase in air resistance by providing the positioning seat parts 22*h* in the air passage W. Thus, power required for the air blowing fan 40 is reduced, so that it is possible to miniaturize the air blowing fan 40.

Furthermore, the space S is provided above the developing roller 24 of the developing container 21 to extend in the front and rear direction, and the opening 21*c* is formed on the front side wall of the upper end part of the developing container 21 to communicate with the space S. The foreign matter collecting device 50 is connected to the opening 21*c* to suck air in the space S through the opening 21*c* and collect foreign matters in the sucked air.

According to this, toner scattered by the air flow passing between the developing roller 24 and the photosensitive drum 11 can be guided into the space S and collected by the foreign matter collecting device 50.

Thus, it is possible to avoid the occurrence of image failure due to the scattered toner attached to the transfer belt 5 or the photosensitive drum 11.

Other Embodiments

The technology of the present disclosure may be configured as follows with respect to the aforementioned embodiment.

In the aforementioned embodiment, the guide plates 22*j* are formed only at the right end part of the bottom wall 22*a* of the bottom cover part 22; however, the technology of the present disclosure is not limited thereto. For example, the guide plates 22*j* may be formed only at the left end part of the bottom wall 22*a* and the air flow in the air passage W may be guided to the air discharge ports 20B on the left side by the guide plates 22*j*. In such a case, it is sufficient if the guide plates 22*j* on the left side are curved to the opposite side to the side of the aforementioned embodiment.

In this way, the air flow rate discharged from the air discharge ports 20B on the left side is larger than that discharged from the air discharge ports 20A on the right side, so that the air flow rate passing between the developing roller 24 and the photosensitive drum 11 is minimized and toner scattering can be suppressed.

Furthermore, the guide plates 22*j* may also be formed only at both right and left end parts of the bottom wall 22*a* of the bottom cover part 22. According to this, the air flow rate discharged from the air discharge ports 20B on the left side becomes equal to that discharged from the air discharge ports 20A on the right side. Thus, it is possible to uniformly cool the entire developing unit 20.

In the aforementioned embodiment, the bottom cover part is composed of a member different from that of the developing container 21; however, the technology of the present disclosure is not limited thereto and the bottom cover part 22 may be integrally formed with the developing container 21.

Furthermore, in the aforementioned embodiment, the image forming apparatus 1 is configured by a color laser printer; however, the technology of the present disclosure is not limited thereto and the image forming apparatus 1 may be a monochrome laser printer. Furthermore, the image forming apparatus 1 is not limited to a printer and may be a facsimile, a copy machine, a multifunctional peripheral (MFP) and the like.

What is claimed is:

1. A developing device comprising:

a developing roller that supplies toner toward an image carrying member;

a developing container that accommodates the developing roller therein;

a bottom cover part that covers a bottom surface of the developing container and forms an air passage extending in an axial direction of the developing roller between the bottom surface and the bottom cover part;

an air supply unit that supplies air into the air passage;

an air receiving port that is provided at one side end part of the air passage in the axial direction of the developing roller and receives the air supplied from an outside of the air passage by the air supply unit; and air discharge ports that are provided on wall parts on both sides in an air passage width direction orthogonal to the axial direction of the developing roller of wall parts forming the air passage and discharge the air flowing into the air passage to the outside of the air passage, wherein the bottom cover part is provided on an upper surface thereof with a guide plate that guides air flow, which flows into the air passage from the air receiving port, toward an air discharge port on at least one side in the air passage width direction.

2. The developing device of claim 1, wherein the bottom cover part is composed of a member different from that of the developing container, and includes a positioning seat part that protrudes from an upper surface of the bottom cover part and a protrusion that protrudes from an upper surface of the positioning seat part and engages with an engaged part formed in the developing container, and the guide plate is provided on an upstream side in an air circulation direction in the positioning seat part to rectify air flow by branching the air flow to both sides in the air passage width direction.

3. The developing device of claim 2, wherein the developing roller is accommodated in an upper end part of the developing container, a space is provided above the developing roller of the developing container to extend in the axial direction of the developing roller, an opening is formed on a wall part of an upper end part of the developing container to communicate with the space, and a foreign matter collecting device is connected to the opening to suck air in the space through the opening and collect foreign matters in the sucked air.

4. The developing device of claim 1, wherein the developing roller is accommodated in an upper end part of the developing container, a space is provided above the developing roller of the developing container to extend in the axial direction of the developing roller, an opening is formed on a wall part of an upper end part of the developing container to communicate with the space, and a foreign matter collecting device is connected to the opening to suck air in the space through the opening and collect foreign matters in the sucked air.

5. An image forming apparatus comprising the developing device of claim 1.

6. A developing device comprising:

a developing roller that supplies toner toward an image carrying member;

a developing container that accommodates the developing roller therein;

a bottom cover part that covers a bottom surface of the developing container and forms an air passage extending in an axial direction of the developing roller between the bottom surface and the bottom cover part;

an air supply unit that supplies air into the air passage;

an air receiving port that is provided at one side end part of the air passage in the axial direction of the developing roller and receives the air supplied from an outside of the air passage by the air supply unit; and air discharge ports that are provided on wall parts on both sides in an air passage width direction orthogonal to the axial direction of the developing roller of wall parts forming the air passage and discharge the air flowing into the air passage to the outside of the air passage, wherein the bottom cover part is composed of a member different from that of the developing container, and includes a positioning seat part that protrudes from an upper surface of the bottom cover part and a protrusion that protrudes from an upper surface of the positioning seat part and engages with an engaged part formed in the developing container, and a guide plate is provided on an upstream side in an air circulation direction in the positioning seat part to rectify air flow by branching the air flow to both sides in the air passage width direction.

7. The developing device of claim 6, wherein the developing roller is accommodated in an upper end part of the developing container, a space is provided above the developing roller of the developing container to extend in the axial direction of the developing roller, an opening is formed on a wall part of an upper end part of the developing container to communicate with the space, and a foreign matter collecting device is connected to the opening to suck air in the space through the opening and collect foreign matters in the sucked air.

8. An image forming apparatus comprising the developing device of claim 6.

9. A developing device comprising:

a developing roller that supplies toner toward an image carrying member;

a developing container that accommodates the developing roller therein;

a bottom cover part that covers a bottom surface of the developing container and forms an air passage extending in an axial direction of the developing roller between the bottom surface and the bottom cover part;

an air supply unit that supplies air into the air passage;

an air receiving port that is provided at one side end part of the air passage in the axial direction of the developing roller and receives the air supplied from an outside of the air passage by the air supply unit; and air discharge ports that are provided on wall parts on both sides in an air passage width direction orthogonal to the axial direction of the developing roller of wall parts forming the air passage and discharge the air flowing into the air passage to the outside of the air passage, wherein the developing roller is accommodated in an upper end part of the developing container, a space is provided above the developing roller of the developing container to extend in the axial direction of the developing roller, an opening is formed on a wall part of an upper end part of the developing container to communicate with the space, and a foreign matter collecting device is connected to the opening to suck air in the space through the opening and collect foreign matters in the sucked air.

10. An image forming apparatus comprising the developing device of claim 9.

* * * * *